US006810820B1

(12) United States Patent
Okerlund et al.

(10) Patent No.: US 6,810,820 B1
(45) Date of Patent: Nov. 2, 2004

(54) ADJUSTABLE WORKSTATION TABLE

(75) Inventors: Kawa-She-Quoen Wm. Okerlund, Wausau, WI (US); Allan S. Malluege, Wausau, WI (US); Todd Krzanowski, Mosince, WI (US); Pat Heidmann, Edgar, WI (US)

(73) Assignee: Fulton Performance Products, Inc., Mosinee, WI (US)

( * ) Notice: Subject to any disclaimer, the term of this patent is extended or adjusted under 35 U.S.C. 154(b) by 132 days.

(21) Appl. No.: 10/254,888

(22) Filed: Sep. 25, 2002

Related U.S. Application Data

(60) Provisional application No. 60/325,526, filed on Sep. 27, 2001.

(51) Int. Cl.[7] ..... A47B 9/00

(52) U.S. Cl. ..... 108/147; 108/137; 108/50.01

(58) Field of Search ..... 108/147, 158.11, 108/158.13, 50.01, 50.02, 153.1, 180, 10, 1, 144.11, 141, 147.19, 49, 137, 143

(56) References Cited

U.S. PATENT DOCUMENTS 2,877,074 A * 3/1959 Oberrauch ..... 108/10
3,221,677 A * 12/1965 Kerr ..... 108/102
4,286,525 A * 9/1981 Willmore ..... 108/93
4,714,224 A * 12/1987 Calmes ..... 248/465
5,447,099 A * 9/1995 Adams et al. ..... 108/147
5,666,888 A * 9/1997 Dame et al. ..... 108/147.21
5,704,299 A * 1/1998 Corpuz et al. ..... 108/50.01
5,941,182 A * 8/1999 Greene ..... 108/147
6,474,246 B2 * 11/2002 Hsu ..... 108/147
6,484,648 B1 * 11/2002 Long ..... 108/147
6,540,191 B2 * 4/2003 Liu ..... 248/422
6,568,335 B2 * 5/2003 Hamilton et al. ..... 108/50.02

* cited by examiner

*Primary Examiner*—Jose V. Chen
(74) *Attorney, Agent, or Firm*—Craig A. Fleschko, Esq.; DeWitt Ross & Stevens S.C.

(57) ABSTRACT

A workstation table includes at least two horizontally oriented spaced worksurface struts which allow a work platform to be placed atop the worksurface struts to extend between them. Leg struts having adjustable length extend downwardly from the workstation struts, and a crank link extending between the leg struts can be rotated to adjust the length of both of the leg struts simultaneously. Base struts extend from the ends of the leg struts opposite the worksurface struts to better support the base struts. Stabilizer struts, which also preferably have adjustable length, extend between the opposing base struts and/or between the opposing leg struts to help maintain them in spaced relation. The various struts are made of tubing and are affixed together with strut clamps formed of clamp shells, with each clamp shell being shaped to complementarily fit about portions of adjoining struts in such a manner that the clamp shells may be affixed about the adjoining portions to attach them together.

19 Claims, 2 Drawing Sheets

100
102
160
114
162
170
168
152
154
156
150
148
144
146
110
104
108
106
164
166
116
116
116
130
128
104
112
126
140
142
118
134
116
116
106
118
120
122
124
138
132
136

ADJUSTABLE WORKSTATION TABLE

CROSS-REFERENCE TO RELATED APPLICATIONS

This application claims priority under 35 USC §119(e) to U.S. Provisional Patent Application No. 60/325,526 filed Sep. 27, 2001, the entirety of which is incorporated by reference herein.

FIELD OF THE INVENTION

This disclosure concerns an invention relating generally to workstation tables, and more specifically to workstation tables configured for use in assembly and fabrication operations, and which can be assembled and broken down quickly with limited tools.

BACKGROUND OF THE INVENTION

Work space is often in short supply in machine shops, factories, and other manufacturing operations. Workers often need to be able to rapidly move, set up, and/or break down work areas depending on the demands of the project at hand. Workstation tables that are currently available provide only a limited solution to this problem, because they are bulky and require extensive time and tools for assembly. Additionally, most current workstation table designs are welded, making them heavy, expensive, and difficult to ship. Existing workstation tables are also generally inflexibly configured, whereas it would be preferable to have a workstation table design which adjusts in one or more dimensions to accommodate a user's current needs.

SUMMARY OF THE INVENTION

The invention involves a workstation table which is intended to at least partially solve the aforementioned problems. To give the reader a basic understanding of some of the advantageous features of the invention, following is a brief summary of preferred versions of the workstation tables. As this is merely a summary, it should be understood that more details regarding the preferred versions may be found in the Detailed Description set forth elsewhere in this document. The claims set forth at the end of this document then define the various versions of the invention in which exclusive rights are secured.

A preferred version of the workstation table includes at least two horizontally oriented spaced worksurface struts which allow a work platform to be placed atop the worksurface struts to extend between them. Leg struts having adjustable length extend downwardly from the workstation struts, and a crank link extending between the leg struts can be rotated to adjust the length of both of the leg struts simultaneously. Base struts extend from the ends of the leg struts opposite the worksurface struts to better support the base struts. Stabilizer struts, which also preferably have adjustable length, extend between the opposing base struts and/or between the opposing leg struts to help maintain them in spaced relation. Owing to the adjustable length of the stabilizer struts, a base strut, leg strut, and worksurface strut situated on one side of a work platform may be spaced at a desired distance from the base strut, leg strut, and worksurface strut situated on the other side of the work platform, thereby allowing the spacing between them to be altered to accommodate differently-sized work platforms atop the worksurface struts.

The various struts are preferably made of tubing and are affixed together with strut clamps. Each strut clamp includes at least two clamp shells, with each clamp shell being shaped to complementarily fit about portions of adjoining struts in such a manner that the clamp shells may be affixed about the adjoining portions to attach them together. Most preferably, the strut clamps take a T-shaped form, with a stem portion (the base of the "T") having a dead-end passage opening onto the middle of a branch portion (the top of the "T") having a through passage. The branch portion may therefore receive any portion along the length of a tubular strut, and the stem portion may receive the end of another strut. Each strut clamp is preferably bisected into two identical strut clamp shells, each including half of the stem portion and half of the branch portion, so that the strut clamp shells can be affixed together with portions of adjoining struts fixed therebetween. Depending on the degree to which the strut clamp shells are affixed together, the passages within the strut clamps have variable size, and therefore they can be fixed about struts having somewhat different diameters. The strut clamps and their strut clamp shells advantageously allow rapid connection and disconnection of struts; do not require that specific struts be matched with specific strut clamps/clamp shells, since the strut clamps can be mated with different struts having different diameters; and allow variation in the configuration of the workstation table, since the branch portions of the strut clamps can be affixed at different locations along a strut.

The leg struts are preferably made to have adjustable length by providing them with leg strut segments which telescopically and coaxially slide with respect to each other. Each leg strut preferably includes a drive shaft which extends through the leg strut at an angle to its axis, wherein rotation of the drive shaft actuates telescopic extension or retraction of the leg strut. The crank link then extends between the drive shafts of the leg struts so that actuation of the crank link (or of any of the drive shafts affixed thereto) will effect actuation of all of the drive shafts, thereby simultaneously adjusting the length of all of the leg struts (and thus the height of the worksurface struts and any work platform thereupon). A crank can also be affixed to a drive shaft of a leg strut to allow easy actuation by a user.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
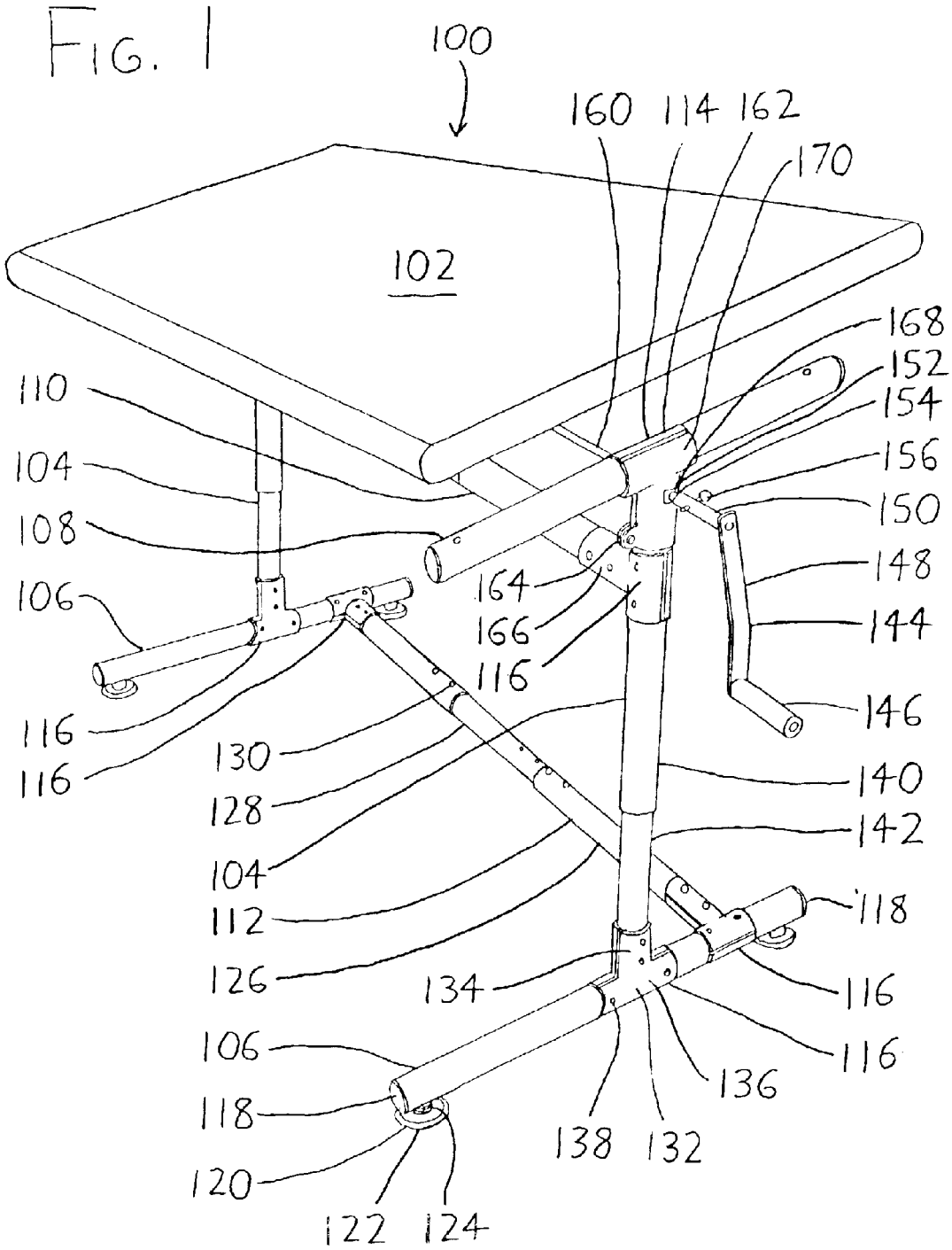
FIG. 1 is perspective view of a preferred version of the workstation table, shown partially exploded such that the work platform 102 is shown elevated above the worksurface struts 108.

A particularly preferred version of a workstation table which exemplifies features of the invention is shown in the accompanying drawings at the reference numeral 100. Referring particularly to FIG. 1, the primary components of the workstation table 100 include a work platform 102 upon which workers may place items for assembly or other operations, and several struts 104, 106, 108, 110, and 112 connected by strut clamps 114 and 116. The struts are each preferably made of one or more segments of tubular material, and they include leg struts 104 which extend from the work platform 102 toward the floor; base struts 106 which serve as an enlarged base for the leg struts 104; worksurface struts 108 which support the work platform 102 atop the leg struts 104; and stabilizer struts 110 and 112 which extend between any of the leg struts 104, base struts 106, and worksurface struts 108 to lend extra rigidity (with FIG. 1 depicting an upper stabilizer strut 110 shown extending between the leg struts 104, and also a lower stabilizer strut 112 extending between the base struts 106). Each of these components will now be discussed in turn.

The work platform 102, which is preferably made of sturdy, lightweight materials, rests atop the worksurface struts 108. The work platform 102 does not need to be planar or rigid, nor need it have a single or continuous surface; all that is necessary is that it be capable of providing an elevated surface upon which activities may be conducted. For example, the work platform 102 shown in FIG. 1 could be formed of a series of tiered shelves (as opposed to a planar slab); a flexible mesh supported by a framework; or a series of slabs which attach end-to-end, or which are affixed by hinges to allow folding from a collapsed state to the erected state shown. It is noted that while the work platform 102 is a beneficial component of the workstation table 100 when the workstation table 100 is in use, the work platform 102 is not an essential part of the invention. It is contemplated that some users would prefer to be provided with the various struts 104, 106, 108, 110 and 112 without also being provided with a work platform 102, so that they may provide their own work platform 102.

The worksurface struts 108, each of which is preferably formed of a length of tubing, support the work platform 102 and rest adjacent and parallel to the ends of the work platform 102. Each worksurface strut 108 also rests parallel to a base strut 106 (with a leg strut 104 extending between each worksurface strut 108 and its corresponding base strut 106). The worksurface struts 108 are affixed to the bottom of the work platform 102 by fasteners (not shown) which pass through the worksurface struts 108 to penetrate the work platform 102. As shown by the lower stabilizer strut 112 in FIG. 1, it is possible to have stabilizer struts which also serve as base struts 106 (and it is similarly possible to have one or more upper stabilizer struts 110 which serve as worksurface struts 108, though none are shown in the drawing). Caps 118 may be provided to fit within or cover exposed ends of struts, for example, at the ends of the worksurface struts 108 and base struts 106.

The base struts 106 are similarly each formed of a length of tubing. Machine legs 120 are preferably provided at the bottoms of the base struts 106. The machine legs 120 depicted in the drawings have discs 122 which support the base struts 106 upon the floor or other surface whereupon the workstation table 100 is placed, with the discs 122 having axially-extending threaded stems 124, with these threaded stems 124 extending within the base struts 106. Rotation of the discs 122 (and thus the stems 124) allows the distance between the discs 122 and the base struts 106 to be variably adjusted. The machine legs 120 can thus be independently adjusted to level the workstation table 100 on the floor where it is situated. In addition to (or in place of) the discs 122, the machine legs 120 can be provided with casters to allow the workstation table 100 to be easily rolled from place to place.

The stabilizer struts 110 and 112 have a segmented telescoping arrangement which allows them to support the base struts 106 and leg struts 104 in spaced relationship while allowing variation in their spacing (since the worksurface struts 108, leg struts 104, and base struts 106 on the opposing ends of the work platform 102 may be differently spaced when attached to work platforms 102 having different lengths). This segmented telescoping arrangement may be best visualized with reference to the lower stabilizer strut 112 in FIG. 1, wherein the lower stabilizer strut 112 is formed of two large-diameter outer strut segments 126 at its outer ends, and a middle smaller-diameter strut segment 128 telescopically received within the outer strut segments 126. A series of apertures may then be provided along each of these strut segments to allow fasteners 130 to be inserted between interfit pairs of strut segments 126 and 128 within coaxially-aligned pairs of apertures. Thus, by aligning a selected aperture on the middle strut segment 128 with a selected aperture on an outer strut segment 126, and inserting a fastener 130 into the aligned apertures, the outer and middle strut segments 126 and 128 are restrained from axially shifting in relation to each other. The outer and middle strut segments 126 and 128 may therefore be telescopically adjusted with respect to each other to adjust the overall length of the lower stabilizer strut 112, and fasteners 130 may be inserted into the strut segments to secure them together and fix the length of the stabilizer strut 112. Such an arrangement for both the upper and lower stabilizer struts 110 and 112 allows the workstation table 100 to accommodate work platforms 102 having different lengths.

Figure 2:
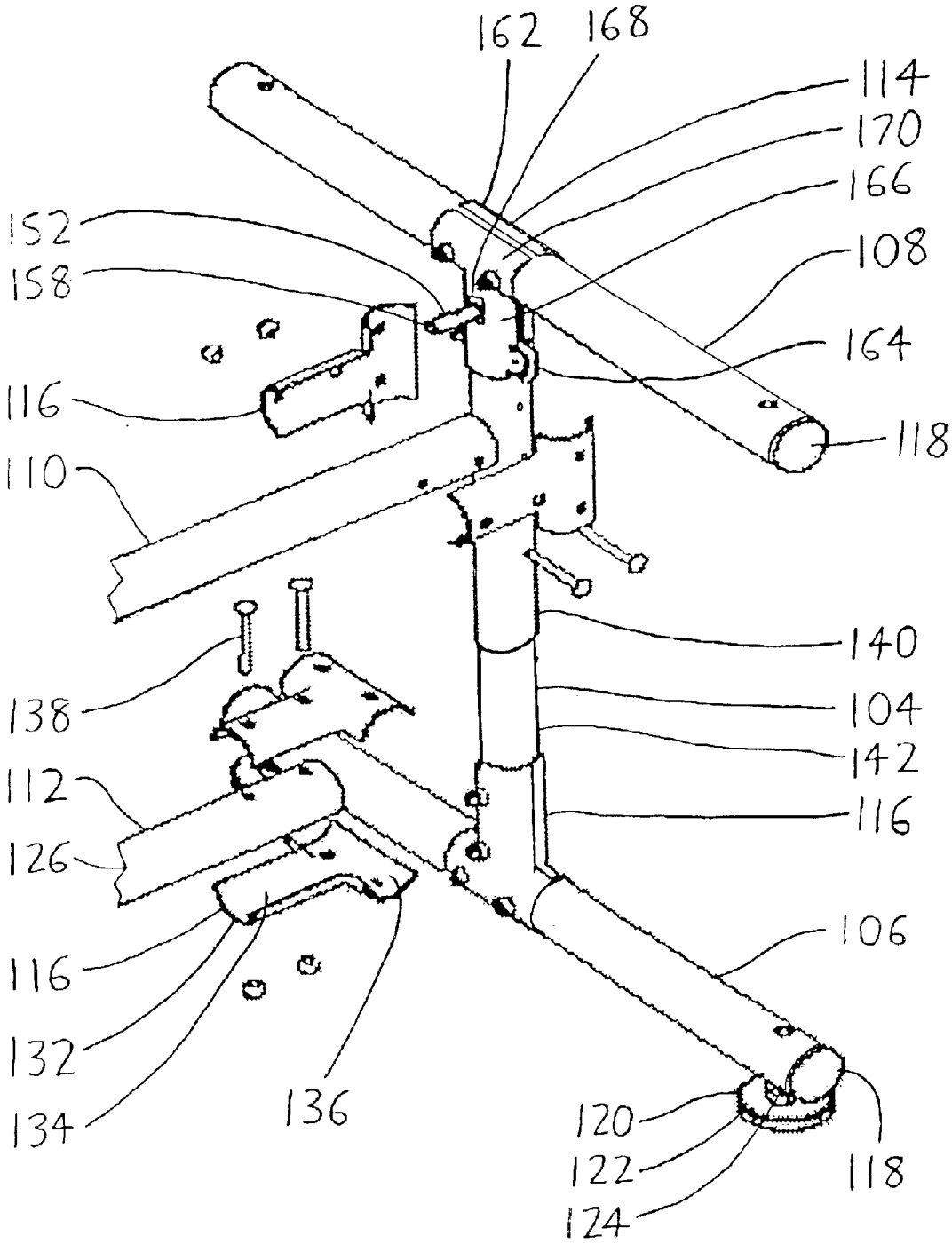
FIG. 2 is a perspective view of a leg strut 104, a base strut 106, a worksurface strut 108, and the stabilizer struts 110 and 112 of FIG. 1, shown with an exploded depiction of the strut clamps 116 used to attach the upper stabilizer strut 110 to the leg strut 104, and to attach the lower stabilizer strut 112 to the base strut 106.

Prior to reviewing the preferred structure of the leg struts 104, it is first useful to review the strut clamps 114 and 116 used to join adjacent struts, which are shown in greater detail in FIG. 2. The strut clamps are of two types, with the strut clamps 114 used to affix the leg struts 104 to the worksurface struts 108 having a different configuration than the strut clamps 116 used to affix the struts elsewhere. Throughout this document, the strut clamps 114 used to affix the leg struts 104 to the worksurface struts 108 may be more specifically referred to as upper strut clamps 114, and the remaining strut clamps may be more specifically referred to as lower strut clamps 116. With specific reference to FIG. 2, a T-shaped lower strut clamp 116 is used to join the base strut 106 to the leg strut 104, and similar lower strut clamps 116 are used to join the stabilizer strut 110 to the leg strut 104 and to join the stabilizer strut 112 to the base strut 106. The lower strut clamps 116 are preferably formed of two or more shells 132 which together define one or more interior passages shaped to complementarily receive adjoining ends of struts. Owing to the T-shape of the lower strut clamp 116, it has a dead-end interior passage at the stem portion 134 of the strut clamp 116 (the portion forming the base of the "T"), and an open-ended interior passage at the branch portion 136 of the strut clamp 116 (the portion forming the top of the "T"). Holes for fasteners then extend through the strut clamp shells 132 so that when the shells 132 are arranged to form a strut clamp 116, the fastener holes are aligned to allow a fastener 138 to extend from one shell 132 to the other, and through any struts resting therebetween. In FIG. 2, the lower strut clamps 116 are shown with four fastener holes in their strut clamp shells 132, with the fastener holes being aligned in the midplanes of the passages defined by the combined strut clamp shells 132. Two fastener holes are situated near opposite ends of the branch portion 136 of the strut clamp 116, and two fastener holes are also situated along the length of the stem portion 134 of the strut clamp 116. When fasteners 138 are extended through the lower strut clamp shells 132 (and any intermediate struts) and are adjusted to draw the strut clamp shells 132 together, the strut clamp shells 132 come together to bear against the struts resting within the interior passages defined by the strut clamp shells 132. Advantageously, the structure of the lower strut clamps 116 allows a lower strut clamp 116 to accommodate different struts which are out of round (as when a strut becomes damaged after an extended period of use), or which have small variations in their diameters (thereby allowing a strut to be formed of whichever tube stock is presently least expensive on the market during the time of manufacture). Additionally, the ability of the lower strut clamps 116 to accommodate slight variations in diameter allows them to be clamped to adjoining ends of struts (as where a pair of shorter-length tubes are placed in abutment at their ends to form a single strut), or to the juncture of two coaxial and telescopically-interfit struts (as where a pair of shorter-length tubes are coaxially interfit to form a single strut). The lower strut clamps 116 (as well as the upper strut clamps 114) thus greatly enhance the versatility of the workstation table 100, in particular its ability to be rapidly assembled and disassembled from a compact collection of parts.

The leg struts 104 depicted in the preferred workstation table 100 shown in the drawings are dissimilar to the remaining struts 106, 108, 110 and 112 in that they have a continuously adjustable telescopic structure, with an upper outer strut segment 140 receiving a lower inner strut segment 142 within its interior. Turning of a crank 144 (shown in FIG. 1) will therefore axially adjust the upper outer strut segment 140 with respect to the lower inner strut segment 142. The crank 144 has a handle 146 attached to a leg portion 148, which is in turn attached to a hollow shaft 150. The leg struts 104 then include a protruding drive shaft 152 (shown in FIG. 1) having a crank end 154 which may be received within the hollow shaft 150 of the crank 144, and a crank fastener 156 may then be inserted through the hollow shaft of the crank 144 and the crank end 154 of the leg strut drive shaft 152 to engage the crank 144 and the leg strut drive shaft 152 together. Thus, when the crank 144 is turned (and the crank fastener 156 is engaged), the drive shaft 152 will also turn. The drive shaft 152 extends into the interior of the upper outer strut segment 140 wherein it engages structure for driving the upper outer strut segment 140 axially with respect to the lower inner strut segment 142. As an example, the drive shaft 152 might actuate a nut and screw assembly, with an example of such structure being shown in U.S. Pat. No. 6,267,357. As another example, the drive shaft 152 might drive a pinion that interacts with a rack in the lower inner strut segment 142. In these and other arrangements, turning the crank 144 causes the upper outer strut segment 140 to axially move over the lower inner strut segment 142, thereby causing the leg strut 104 to elongate or collapse (and thereby adjust the height of any work platform 102 atop the leg struts 104 and worksurface struts 108).

Looking to FIG. 1, each leg strut drive shaft 152 extends through its leg strut 104 near its end (and through any upper strut clamp 114 thereon), and along an axis perpendicular to the axis of its leg strut 104, so that the crank end 154 of the leg strut drive shaft 152 extends from one side of its leg strut 104 (as shown in FIG. 1) and an opposing link end 158 extends from the opposite side of the leg strut 104 (shown in FIG. 2). An elongated crank link 160, partially visible in FIG. 1, has hollow ends which may fit over the link ends 158 of the leg strut drive shafts 152 and engaged thereon with use of a fastener. Thus, when the workstation table 100 is assembled, the leg struts 104 at the opposite ends of the workstation table 100 are arranged so that their leg strut drive shafts 152 have their crank ends 154 facing outwardly (thereby allowing a user to easily access either leg strut drive shaft 152 to place a crank 144 thereon), and their link ends 158 face inwardly towards each other. The crank link 160 is then situated between the link ends 158 of the leg strut drive shafts 152 and engaged to the link ends 158 with a fastener, thereby rotationally linking the leg strut drive shafts 152 together. When a user then actuates a crank 144 installed on the leg strut drive shaft 152 of either leg strut 104, the crank link 160 transmits the rotation from one leg strut drive shaft 152 to the other, causing them to rotate in tandem and thereby telescopically extend or collapse by the same distance. Both leg strut drive shafts 152 are thus rotated simultaneously to allow the opposing ends of the work platform 102 to raise or drop by the same amount. Alternatively, if the crank link 160 is disengaged from the link ends 158 of the leg strut drive shafts 152 (or is eliminated), each leg strut 104 can be independently cranked to attain a different height than the other leg strut 104, though this arrangement might be limited by the work platform 102 and/or the upper stabilizer strut(s) 110 if these are rigidly linked to the upper outer strut segments 140 of the leg struts 104. The crank link 160 may be formed of segments which are telescopically interfit (as with the stabilizer struts 110 and 112), or which otherwise provide the crank link 160 with adjustable length, so that the length of the crank link 160 may be adjusted to accommodate any adjustment in the lengths of the stabilizer struts 110 and 112, as when the struts are adapted to support a differently-sized work platform 102.

The upper strut clamps 114 have a T-shaped configuration which is generally similar to that used for the other strut clamps 116, but their upper strut clamp shells 162 have ears 164 on their stem portions 166, and their stem portions 166 additionally include a drive shaft aperture 168 wherein a leg strut drive shaft 152 may be received. The branch portions 170 of the upper strut clamp shells 162 have two fastener holes situated near their opposite ends to allow insertion of fasteners through the branch portions 170 of two upper strut clamp shells 162, and through any worksurface struts 108 situated therebetween, to engage the branch portions 170 of the upper strut clamp shells 162 to the worksurface struts 108. Fasteners may also be extended through the ears 164 of the stem portions 166 of two upper strut clamp shells 162 to affix the stem portions 166 together about a leg strut 104, with the leg strut drive shaft 152 resting within the drive shaft apertures of the stem portions. The upper strut clamps 114 therefore do not bear any fasteners which extend from their stem portions 166 into the leg strut 104 to bind its telescoping upper outer strut segment 140 and lower inner strut segment 142 together.

Since the foregoing workstation table 100 is clamped together rather than welded, it may easily be broken down into a compact size for transport. Clamping also allows different lengths of tubing to be used for differently-sized work platforms 102; for example, use of worksurface struts 108 having different lengths allows use of the remaining struts with work platforms 102 of different width, and use of stabilizer struts 110 and 112 having different lengths allows use of the remaining struts with work platforms 102 of different length. Longer base struts 106 may be accommodated to increase stability of the workstation table 100, or shorter base struts 106 may be accommodated in situations where the footprint of the workstation table 100 needs to be decreased. The use of tubing also allows more compact storage in situations where the various struts can be telescopically interfit together.

It is understood that the various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

Initially, not all of the illustrated leg, base, worksurface, and stabilizer struts 104, 106, 108, 110, and 112 are essential, and one or more of these may be omitted (for example, one or both of the stabilizer struts 110 and/or 112 may be omitted). Alternatively, further struts could be added. While the struts are preferably made of tubular material, they may be made of solid materials instead, and they need not have a circular cross-section.

The leg struts 104 and stabilizer struts 110/112 need not have the telescoping structure described and could instead be formed (for example) of a unitary length of material. Conversely, when the base struts 106 and worksurface struts 108 are made of tubular materials, it may be advantageous to have either or both of these struts formed of two or more segments of tubular material, allowing larger-diameter strut segments to telescopically receive smaller-diameter strut segments (as with the arrangement discussed above for the stabilizer struts 110 and 112). This allows strut segments to be telescopically stored as a unit, and additionally allows a strut to have adjustable length by telescopically expanding or collapsing mating pairs of strut segments. Consider FIG. 2, wherein a base strut 106 is shown affixed to a leg strut 104 via a strut clamp 116. The base strut 106 might consist of a pair of base strut segments which rest end-to-end, and which are affixed together (and to the leg strut 104) via the strut clamp 116. The base strut segments forming the base strut 106 may have the same diameter, or may have different diameters to allow a telescoping arrangement. Slightly differing diameters between the base strut segments would not prevent the strut clamp 116 from firmly grasping both of them: because the fasteners used to affix the strut clamp shells 132 together are situated on each side of the branch portion 136 of the strut clamp 116, each side of the branch portion 136 may be independently tightened to a sufficient degree about the strut segment it receives.

Where struts are formed in telescopically interfit segments, a number of arrangements may be used to fix them together in lieu of the aforementioned use of fasteners. As examples, the segments may have engaging threading; may be frictionally interfit; or may engage each other by collet/chuck arrangements or other structure whereby the diameter of an outer strut segment is reduced about the inner strut segment therein (or wherein the diameter of an inner strut segment is enlarged to engage the surrounding outer strut segment).

The strut clamps 114 and 116 may be formed as a unit rather than in two or more shells 132 and 162, and may have a wide variety of configurations depending on the desired form of the assembled struts. Rather than allowing 3-way connections (as with the T-shaped strut clamps 114 and 116, or a Y-shaped strut clamp), they may instead allow only 2-way connections (e.g., for use in connecting adjacent ends of strut segments), or could allow 4-way connections (e.g., as with an X-shaped strut clamp) or more.

The worksurface struts 108 need not be directly affixed to the bottom of the work platform 102 by fasteners, and might instead be attached (for example) by U-shaped brackets having protruding ears at their ends. The ears could be affixed to the bottom of the work platform 102 so that the bodies of the brackets descend to define passages wherein the worksurface struts 108 are situated. Thus, the worksurface struts 108 may be affixed to the work platform 102 by situating the work platform 102 atop the worksurface struts 108, fitting the U-shaped brackets over the worksurface struts 108 so that the ears contact the bottom of the work platform 102, and attaching the ears to the bottom of the work platform 102 with fasteners. The degree to which the fasteners would be tightened could affect the degree to which the worksurface struts 108 are fastened between the U-shaped brackets and the bottom of the work platform 102, and the brackets could thereby accommodate worksurface struts 108 having different diameters.

To enhance the degree to which each strut clamp 114 and/or 116 may grasp any struts (or strut segments therein), each strut clamp shell 132/162 can optionally include a clamp liner which is shaped to complementarily fit within the strut clamp shell 132/162, and which is preferably at least somewhat elastic and has a high coefficient of friction. As an example, such a clamp liner may be formed of a rubber coating provided on the interior surface of a strut clamp shell 132/162. Such clamp liners, when provided in the strut clamp shells 132/162, help to better engage the ends of the struts resting within the strut clamps 114 and 116. Additionally, if the clamp liners are compressible, they can better engage adjoining struts which have marginally different outer diameters. However, any strut clamp liners need not necessarily cover the entireties of the interior surfaces of their strut clamp shells 132/162. For example, rubber washers may be situated in the interior surfaces of the strut clamp shells 132/162 about the fastener holes, and can help serve to have the strut clamp shells 132 firmly grip the struts when they are fastened about the struts.

The various fasteners used to affix the foregoing components together are preferably of a sort that may be fastened and unfastened by hand or with the use of simple tools, e.g., bolts, pins, etc. Fasteners allowing assembly and disassembly without the use of tools are particularly preferred.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A workstation table comprising:

a. at least two spaced worksurface struts, the worksurface being horizontally oriented to accommodate a work platform atop and between the worksurface struts;

b. at least two spaced leg struts, each leg strut descending from one of the workstation struts, wherein the leg struts each include leg strut segments which slide with respect to each other in parallel relation to adjust the length of the leg strut;

c. at least two base struts, each base strut extending horizontally from one of the leg struts;

d. strut clamps wherein:

(1) each strut clamp joints:

i. one of the worksurface struts to one of the leg struts, or ii. one of the base struts to one of the leg struts, and (2) each strut clamp includes at least two clamp shells wherein:

i. each lamp shell is adapted to accommodate a portion of at least one of the struts which it joins, and ii. the clamp shells of each strut clamp may be affixed together with at least one of the struts to which the strut clamp is joined resting therebetween:

e. a crank link extending between the leg struts, wherein rotation of the crank link causes concurrent length adjustment in the leg struts.

2. The workstation table of claim 1 wherein:

a. within each leg strut, one of the leg strut segments has a drive shaft extending generally perpendicularly to the length of the leg strut and also extending through opposing sides of the leg strut; and b. the crank link extends between the drive shafts of the leg struts.

3. The workstation table of claim 2 further comprising a crank affixed to the drive shaft of one of the leg struts.

4. The workstation table of claim 2 wherein the leg strut segments within each leg strut are coaxially and telescopically fit together.

5. The workstation table of claim 2 wherein the drive shafts extend through the strut clamps.

6. The workstation table of claim 1 wherein the strut clamp shells are identical.

7. The workstation table of claim 1 further comprising at least one stabilizer strut, each stabilizer strut extending between:

a. a pair of the base struts, or b. a pair of the leg stats, wherein each stabilizer strut includes at least a pair of stabilizer strut segments which are slideable with respect to each other in parallel relation to thereby allow adjustment in the length of the stabilizer strut.

8. A workstation table comprising:

a. at least two spaced horizontally oriented worksurface struts whereupon a work platform may be placed;

b. at least two spaced horizontally oriented base struts, each base strut also being spaced from one of the worksurface struts;

c. at least two spaced leg struts, each leg strut extending downwardly from one of the workstations struts to one of the base struts, wherein the leg struts have adjustable length to thereby allow adjustment in the height of the worksurface struts;

d. at least one stabilize strut each stabilizer strut extending between:

i. a pair of the base struts, or ii. a pair of the leg struts, wherein each stabilizer strut includes at least a pair of stabilizer strut segments which slide with respect to each other in parallel relation to adjust the length of the stabilizer strut:

e. strut clamps wherein:

(1) each strut clamp joins:

i. one of the base struts to one of the leg struts, or ii. one of the stabilizer struts to one of the base struts or one of the leg struts:

(2) each strut clamp includes at least two clamp shells wherein:

i. each clamp shell is shaped to receive a portion of at least one of the struts which it join, and ii. the clamp shells of each strut damp may be affixed together with the struts to which the strut clamp joined resting between the clamp shells.

9. The workstation table of claim 8 wherein each strut clamp has:

a. a sun portion affixed to one of the opposing ends of the stabilizer strut, and b. a branch portion having an internal passage sized to receive one of the base struts or one of the leg struts therein, wherein the internal passage has adjustable size.

10. The workstation table of claim 8 wherein the strut clamp shells are identical.

11. The workstation table of claim 8 wherein:

a. the leg struts each include at least a pair of leg strut segments which slide with respect to each other in parallel relation to adjust the length of the leg strut; and b. a crank link extends between the leg struts and adjusts their lengths simultaneously.

12. The workstation table of claim 11 wherein:

a. each leg strut includes a drive shaft extending through opposing sides of the leg strut, b. the crank link extends between the drive shafts of the leg struts, and c. at least one of the leg struts has a crank affixed to its drive shaft.

13. A workstation table comprising:

a. at least two horizontally-extending worksurface struts, the worksurface struts being spaced to accommodate a work platform atop the worksurface struts and extending therebetween;

b. at least two spaced leg struts, each leg strut extending downwardly from one of the workstation struts, wherein the leg struts have adjustable length;

c. a crank link extending between the leg struts, wherein rotation of the crank link causes concurrent length adjustment in the leg struts;

d. at least two base struts, each base strut:

i. being spaced from one of the worksuface struts with one of the leg struts situated between the base strut and the worksurface strut, and ii. extending horizontally from one of the leg struts;

e. at least one stabilizer strut, each stabilizer strut extending between:

i. a pair of the base struts, or ii. a pair of the leg struts, wherein each stabilizer strut has adjustable length;

f. strut clamps joining adjacent struts, the strut clamps each including at let two clamp shells, wherein:

i. each clamp shell is adapted to accommodate a portion of at least one of the struts therein, and ii. the clamp shells may be affixed together with at least one of the struts resisting therebetween.

14. The workstation table of claim 13 wherein each leg strut includes leg strut segments which slide with respect to each other in parallel relation to adjust the length of the leg strut.

15. The workstation table of claim 13 wherein each stabilize so includes stabilizer strut segments which slide with e to each other in parallel relation to adjust the length of the stabilizer strut.

16. The workstation table of claim 13 wherein:

a. each leg strut includes a drive shaft, b. the crank link extends between the drive shafts of the leg struts, and c. the drive shaft of at least one of the leg struts includes a crank thereon.

17. A workstation table comprising:

a. at least two spaced horizontally oriented worksurface struts whereupon a work platform may be placed;

b. at least two spaced horizontally oriented base struts, each base strut also being spaced from one of the worksurface struts;

c. at least two spaced leg struts, each leg strut extending downwardly from one of the workstation struts to one of the base struts, wherein the leg struts have adjustable length to thereby allow adjustment in the height of the worksurface struts;

d. at least one stabilizer strut, each stabilizer strut extending between:
i. a pair of the base struts, or
ii. a pair of the leg struts,
wherein each stabilizer strut:
(1) includes at least a pair of stabilizer strut segments which slide with respect to each other in parallel relation to adjust the length of the stabilizer strut;
(2) has opposing ends with strut clamps thereon, each strut clamp having
a. a stem portion affixed to one of the opposing ends of the stabilizer strut, and
b. a branch portion having an internal passage sized to receive one of the base struts or one of the leg struts therein,
wherein the internal passage has adjustable size.

18. The workstation table of claim 17 wherein each strut clamp is formed of at least two strut clamp shells, wherein the strut clamp shells are each shaped to complementarily receive a portion of, and be fit about opposing sides of:
a. a portion of one of the opposing ends of the stabilizer strut, and
b. a portion of one of the base struts or one of the leg struts, with the strut clamp shells being affixed together.

19. The workstation table of claim 18 wherein the clamp shells are identical.

* * * * *